US011391226B2

(12) United States Patent
Aono et al.

(10) Patent No.: US 11,391,226 B2
(45) Date of Patent: Jul. 19, 2022

(54) INTERNAL COMBUSTION ENGINE CONTROL DEVICE AND INTERNAL COMBUSTION ENGINE CONTROL METHOD

(71) Applicant: HITACHI AUTOMOTIVE SYSTEMS, LTD., Hitachinaka (JP)

(72) Inventors: Toshihiro Aono, Tokyo (JP); Masayuki Saruwatari, Hitachinaka (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 0 days.

(21) Appl. No.: 16/954,261

(22) PCT Filed: Feb. 5, 2019

(86) PCT No.: PCT/JP2019/003948
§ 371 (c)(1),
(2) Date: Jun. 16, 2020

(87) PCT Pub. No.: WO2019/163507
PCT Pub. Date: Aug. 29, 2019

(65) Prior Publication Data

US 2021/0079857 A1 Mar. 18, 2021

(30) Foreign Application Priority Data

Feb. 26, 2018 (JP) ..... JP2018-032518

(51) Int. Cl.
*F02D 35/02* (2006.01)
*F02B 23/10* (2006.01)
*F02D 41/14* (2006.01)

(52) U.S. Cl.
CPC ..... *F02D 35/023* (2013.01); *F02B 23/104* (2013.01); *F02D 35/028* (2013.01);
(Continued)

(58) Field of Classification Search
CPC ..... F02D 35/02; F02D 35/023; F02D 35/028; F02D 41/1401; F02D 2041/1401;
(Continued)

(56) References Cited

U.S. PATENT DOCUMENTS 7,806,100 B2 * 10/2010 Schnorbus ..... F02D 41/40 123/299
2020/0300194 A1 * 9/2020 Nagasawa ..... F02D 41/2454

FOREIGN PATENT DOCUMENTS

EP 2143921 A1 1/2010
JP 10-122016 A 5/1998
(Continued)

*Primary Examiner* — Joseph J Dallo
(74) *Attorney, Agent, or Firm* — Volpe Koenig

(57) ABSTRACT

To accurately evaluate combustion stability in consideration of the effect of the trend even at the time of the transient operation. The present invention is configured to have a combustion energy calculation unit that calculates a combustion energy W_t of one combustion cycle in an internal combustion engine, a trend calculation unit that calculates a trend Tr of change in the combustion energy W_t calculated by the combustion energy calculation unit in a plurality of the combustion cycles, and a combustion stability judgment unit that judges combustion stability based on the combustion energy W_t in the plurality of combustion cycles and the trend Tr of change calculated by the trend calculation unit.

13 Claims, 13 Drawing Sheets

(52) U.S. Cl.
CPC .. *F02D 41/1401* (2013.01); *F02D 2041/1412* (2013.01); *F02D 2200/1015* (2013.01)

(58) Field of Classification Search
CPC ..... F02D 2041/1412; F02D 2200/1015; F02B 23/104
See application file for complete search history.

(56) References Cited

FOREIGN PATENT DOCUMENTS

| | | | |
|---|---|---|---|
| JP | 2007-170203 | A | 7/2007 |
| JP | 2008-274876 | A | 11/2008 |
| JP | 2011-106403 | A | 6/2011 |

* cited by examiner

INTERNAL COMBUSTION ENGINE CONTROL DEVICE AND INTERNAL COMBUSTION ENGINE CONTROL METHOD

TECHNICAL FIELD

The present invention relates to an internal combustion engine control device and an internal combustion engine control method.

BACKGROUND ART

PTL 1 discloses an internal combustion engine combustion state detecting device that detects the combustion state of each cylinder group by combustion state detection means in an internal combustion engine including combustion state control means for adjusting the air-fuel mixture component state so as to achieve a target combustion state of air-fuel mixture introduced into each of a plurality of cylinder groups, into which a plurality of cylinders are divided, and adjusting the air-fuel mixture component state so as to converge the combustion state among the cylinder groups to the same state, the combustion state detecting device including combustion state detection prohibiting means for prohibiting detection of a combustion state by the combustion state detection means before the passage of a reference convergence period in which the combustion state among the cylinder groups is expected to converge to the same state by adjusting the air-fuel mixture component state.

CITATION LIST

Patent Literature

PTL 1: JP 2011-106403 A

SUMMARY OF INVENTION

Technical Problem

The operating state of an internal combustion engine (engine) is divided into a steady state and a transient state. The steady state is a state in which the engine speed and torque are constant, and the transient state is a state in which the engine speed and torque are changing. In the development of engines, engine characteristics are often evaluated in the steady state. On the other hand, when a vehicle travels on a road, there are very few regions where the vehicle is operated in the steady state, and most regions are where the vehicle is operated in the transient state.

It is considered that many of the conventional inventions disclosed regarding the combustion state detection method have been based on the knowledge obtained in a performance evaluation at the development stage of the engine. Therefore, most of the detection methods are a detection method applicable only to the steady state or a detection method that determines the steady state and the transient state and detects the combustion state in a case of the steady state and inhibits detection of the combustion state in a case of the transient state (see PTL 1).

However, as described above, in actual operation, there are a few regions operated in the steady state, and most regions are operated in the transient state. It is also difficult to clarify the criteria for distinguishing between the normal state and the transient state. Therefore, an object of the present invention is to provide a combustion state detection method applicable also at the time of the transient state.

Solution to Problem

In order to solve the above problem, the present invention is configured to have a combustion parameter calculation unit that calculates a combustion parameter of one combustion cycle in an internal combustion engine, a trend calculation unit that calculates a trend of change in the combustion parameter calculated by the combustion parameter calculation unit in a plurality of the combustion cycles, and a combustion stability judgment unit that judges combustion stability based on the combustion parameter in the plurality of combustion cycles and the trend of change calculated by the trend calculation unit.

Advantageous Effects of Invention

According to the present invention, it is possible to accurately evaluate combustion stability in consideration of the effect of the trend even at the time of the transient operation.

DESCRIPTION OF EMBODIMENTS

Hereinafter, embodiments of the present invention will be described in detail with reference to the drawings.

First Embodiment

First, an engine control unit (ECU) 1 that controls an internal combustion engine according to an embodiment of the present invention will be described. Hereinafter, the ECU 1 is referred to as the control device 1.

In the present embodiment, a case in which the internal combustion engine control device 1 is applied to an internal combustion engine 100 for a vehicle will be described as an example.

Figure 1:
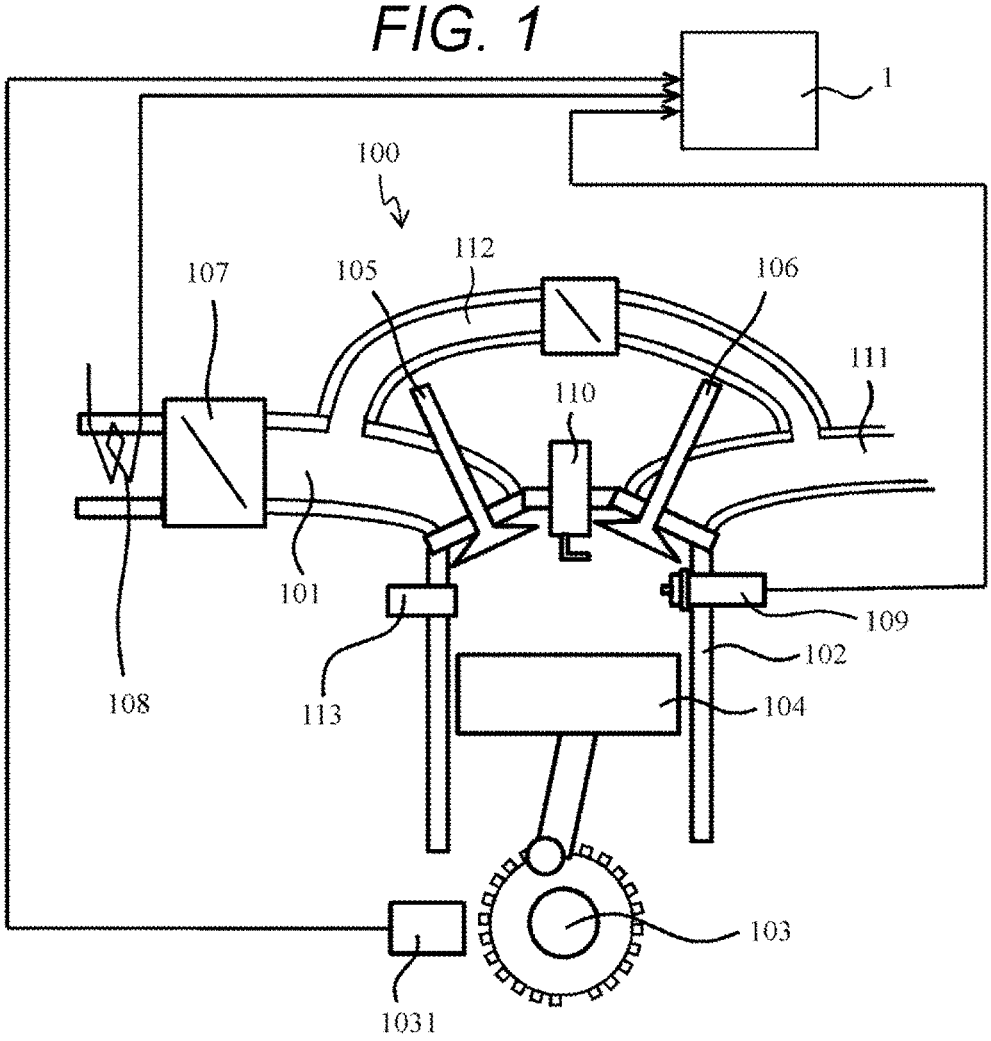
FIG. 1 is a diagram schematically describing an internal combustion engine.
Figure 2:
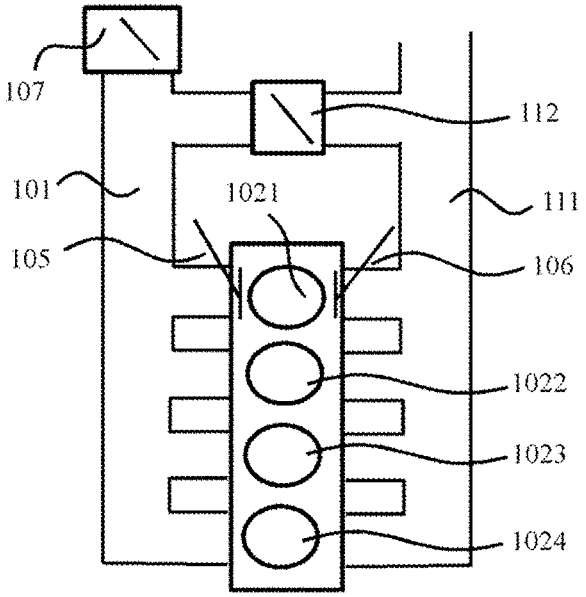
FIG. 2 is a schematic diagram describing an in-line four cylinders of the internal combustion engine.

FIGS. 1 and 2 are schematic diagrams describing the internal combustion engine 100 according to the present embodiment.

In the present embodiment, a 4-cylinder 4-stroke-cycle gasoline engine is described as an example of the internal combustion engine 100, but the number of cylinders and the number of cycles of the internal combustion engine 100 are not limited thereto.

As illustrated in FIG. 1, the internal combustion engine 100 takes air into a cylinder 102 through an intake pipe 101. In the cylinder 102, a piston 104 coupled to a crankshaft 103 moves vertically in synchronization with the rotation of the crankshaft 103, and an intake valve 105 and an exhaust valve 106 open and close in synchronization with this movement. Air is taken into the cylinder 102 by the synchronization between the vertical movement of the piston 104 and the opening and closing of the intake valve 105 and the exhaust valve 106.

An intake air amount taken into the cylinder 102 is adjusted by adjusting the opening of a throttle valve 107 provided in the intake pipe 101 based on an accelerator operation by a driver. The intake air amount is measured by an air flow sensor 108 provided in the intake pipe 101. The measured intake air amount is divided by a target air-fuel ratio determined by an engine speed, an intake pipe pressure, and the like, thereby calculating a target fuel injection amount, and fuel is injected from an injector 109 in accordance with the target fuel injection amount.

The air-fuel mixture of air taken into the cylinder 102 and fuel injected from the injector 109 is ignited by an ignition plug 110, whereby the air-fuel mixture explodes. The air-fuel mixture expanded by the explosion depresses the piston 104, and the depressing movement of the piston 104 is converted into a rotation of the crankshaft 103, which becomes a driving force of the vehicle. An EGR pipe 112 is provided from an exhaust pipe 111 toward the intake pipe 101. Pumping loss can be reduced by returning the combusted air-fuel mixture to the intake pipe 101. The throttle valve 107, the injector 109, and the ignition plug 110 are controlled by the control device 1 connected to the internal combustion engine 100. The control device 1 controls the air-fuel ratio and ignition timing by controlling the operating state and the environmental state of the internal combustion engine 100.

As illustrated in FIG. 2, the internal combustion engine 100 is provided with four cylinders 102 in series.

In the present embodiment, a first cylinder 1021, a second cylinder 1022, a third cylinder 1023, and a fourth cylinder 1024 are provided in that order from the side close to the throttle valve 107. Here, in the internal combustion engine 100, there is a difference in the intake amount of air from the intake pipe 101 and the intake amount of exhaust gas from the EGR pipe 112 between a cylinder close to the throttle valve 107 (e.g., cylinder 1021) and a cylinder far from the throttle valve 107 (e.g., cylinder 1024).

As a result, in the internal combustion engine 100, the stability of combustion differs depending on the cylinders 1021 to 1024 even if the same amount of fuel is injected from a fuel injection device 109 provided for each of the cylinders 1021 to 1024. Conventionally, fuel consumption performance and exhaust performance of an internal combustion engine are within an allowable range even if the difference in combustion stability between cylinders is ignored. However, there is an increasing demand for correction of the difference in combustion stability between cylinders in accordance with a demand for further improvement of fuel consumption performance and exhaust performance in lean combustion, EGR combustion, and the like of the internal combustion engine.

Figure 3:
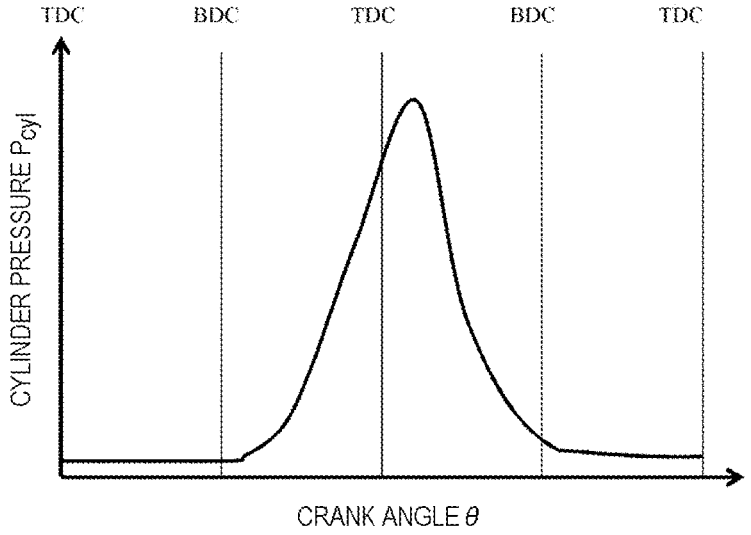
FIG. 3 is a graph illustrating a relationship between a crank angle and a cylinder pressure in a cylinder of the internal combustion engine.
Figure 4:
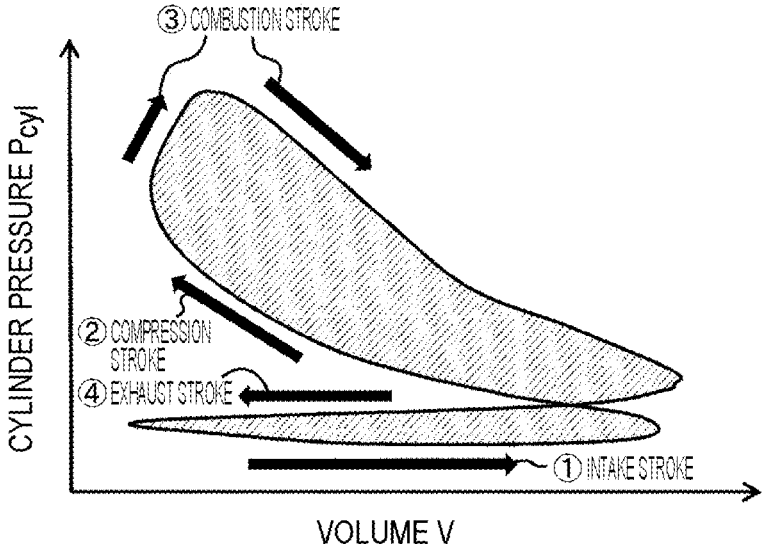
FIG. 4 is a chart describing four strokes of the cylinder of the internal combustion engine.

Therefore, the internal combustion engine 100 according to the present embodiment is provided with a cylinder pressure sensor 113 (see FIG. 1) for each of the cylinders 1021 to 1024 in order to detect the combustion state of each of the cylinders 1021 to 1024. FIG. 3 presents the relationship between a cylinder pressure Pcyl of each of the cylinders 1021 to 1024 measured by the cylinder pressure sensor 113 and a rotation angle (crank angle θ) of the crankshaft 103 detected by a crank angle sensor 1031. FIG. 4 presents the relationship between the cylinder pressure Pcyl and a volume V in the cylinder 102.

In FIG. 3, the horizontal axis represents the crank angle θ, and the vertical axis represents the cylinder pressure Pcyl. In the internal combustion engine 100, the piston 104 reciprocates twice (crankshaft 103 rotates 720 degrees) between a top dead center (TDC) and a bottom dead center (BDC) in one combustion cycle, and the four strokes of an intake stroke, a compression stroke, a combustion (explosion) stroke, and an exhaust stroke are performed during this period.

In FIG. 4, the horizontal axis represents the volume V of the cylinder 102, and the vertical axis represents the cylinder pressure Pcyl. In the internal combustion engine 100, a work amount W, which is performed in one combustion cycle by one cylinder 102, can be expressed by Equation 1 as follows, in accordance with the area (hatched portion in FIG. 4) formed by the four strokes performed in one combustion cycle.

$$W=\int_{IntakeTDC}^{IntakeTDC+720deg} P_{cyl}dV \qquad \text{[Equation 1]}$$

A work amount W/V per unit volume, which is obtained by dividing the work amount W for one combustion cycle of one cylinder by the volume V of the cylinder, is referred to as an indicated mean effective pressure (IMEP). The IMEP is widely used as a value representing combustion energy of the internal combustion engine 100.

Figure 5:
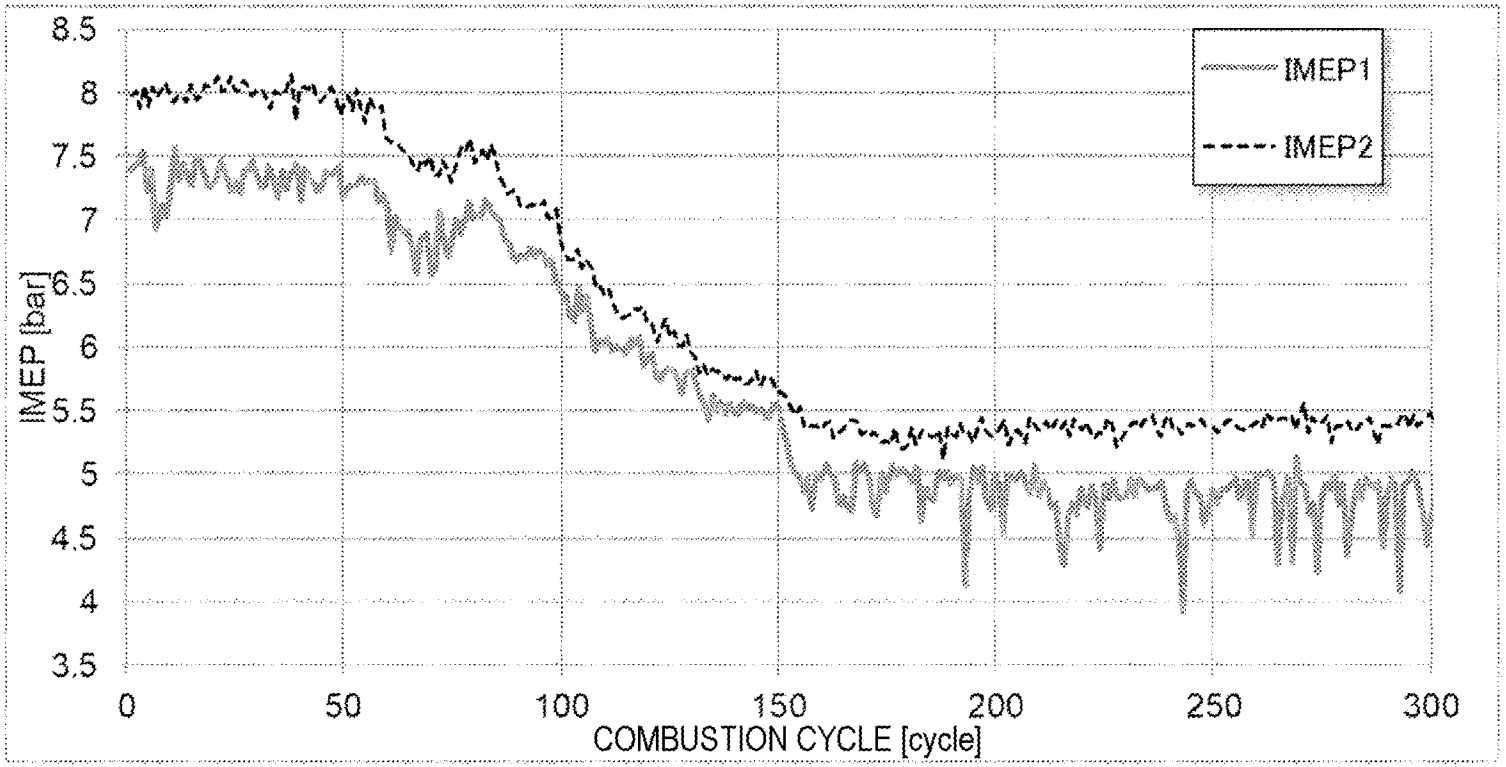
FIG. 5 is a graph illustrating change in IMEP per combustion cycle in the cylinder of the internal combustion engine.

FIG. 5 is a graph illustrating change in IMEP (combustion energy) calculated per combustion cycle in one cylinder. For convenience of explanation, FIG. 5 illustrates changes in IMEP1 (solid line in the figure) of the first cylinder 1021 and IMEP2 (dashed line in the figure) of the second cylinder 1022 of the cylinders 1021 to 1024. In FIG. 5, the IMEP is large in a period of 0 to 50 cycles. It is indicated that the fluctuation of the IMEP is small in this period because the load of the internal combustion engine 100 is high. Furthermore, it is indicated that the load of the internal combustion engine 100 gradually decreases in a period of 80 to 180 cycles, and the fluctuation of the IMEP per combustion cycle is small. In a period of 180 to 300 cycles, the IMEP is small. That is, in this period, the load of the internal combustion engine 100 decreases, and the fluctuation of the IMEP1 of the first cylinder 1021 per combustion cycle increases. Accordingly, it is indicated that the combustion in the first cylinder 1021 becomes unstable in the period of 180 to 300 cycles.

In order to quantify this instability, there is a method of evaluating combustion stability using a parameter cPi calculated from a mean value μ and a standard deviation σ of IMEP of a plurality of past combustion cycles. This parameter cPi can be expressed by Equation 2 below. This method assumes several tens to hundred cycles as the number of cycles to be averaged for evaluation of combustion stability. That is, cPi is calculated per cycle by using the mean value μ and the standard deviation σ of IMEP in several tens to hundred cycles of set cycles in the past. It is judged that combustion is stable if the value of cPi is equal to or less than a threshold value (set threshold value), and it is judged that combustion is unstable if the value of cPi exceeds the set threshold value.

$$cPi = \frac{\sigma(IMEP)}{\mu(IMEP)} \quad \text{[Equation 2]}$$

Figure 6:
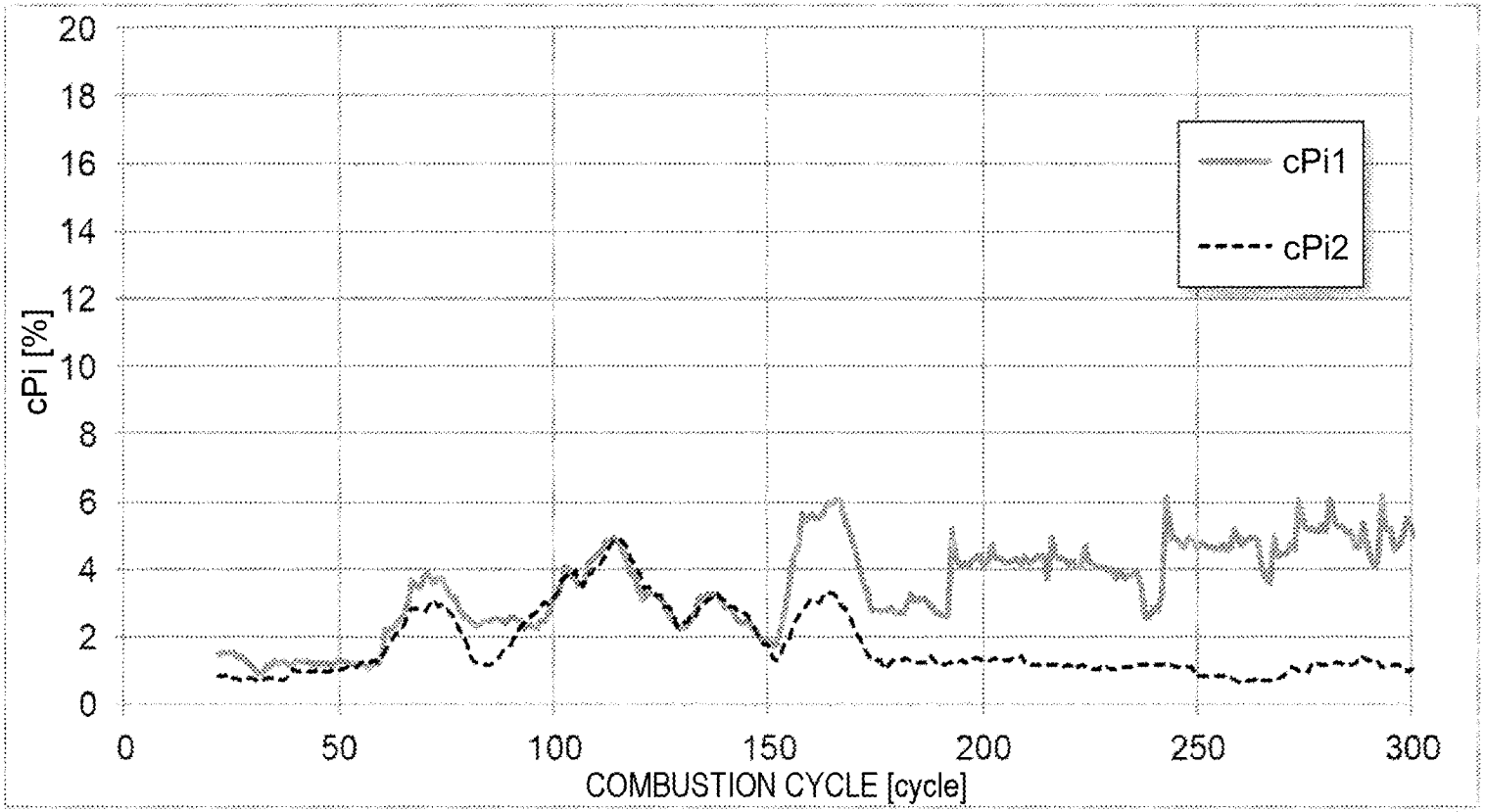
FIG. 6 is a graph illustrating change in Cpi per combustion cycle in the cylinder of the internal combustion engine.

FIG. 6 illustrates cPi calculated from the time series of the IMEP of FIG. 5 using Equation 2. In FIG. 6, the horizontal axis represents the combustion cycle, and the vertical axis represents the parameter cPi described above. In FIG. 6, cPi of the first cylinder 1021 is represented by cPi1 (solid line in the figure), and cPi of the second cylinder 1022 is represented by cPi2 (dashed line in the figure). FIG. 6 will be described below. The set threshold value of cPi for evaluating the combustion stability is 2 in the following description.

(1) First, in the period of 0 to 50 cycles in FIG. 6, the value of cPi for each of the first cylinder 1021 and the second cylinder 1022 is equal to or less than 2. Accordingly, it can be determined that the combustion states of the first cylinder 1021 and the second cylinder 1022 in this cycle period are both stable. Waveforms (see FIG. 5) of IMEP1 and IMEP2 before cPi is calculated indicate that the fluctuation of IMEP1 and IMEP2 per combustion cycle in this period is small. Accordingly, the result of determining that the combustion is stable in both the first cylinder 1021 and the second cylinder 1022 based on cPi1 and cPi2 described above is considered to be reasonable.

(2) Next, in the period of 180 to 300 cycles, the value of cPi2 of the second cylinder 1022 is equal to or less than 2. That is, it can be determined that the combustion state of the second cylinder 1022 in this period is stable. On the other hand, the value of cPi1 of the first cylinder 1021 exceeds 2, which is determined to be unstable. Waveforms (see FIG. 5) of IMEP1 and IMEP2 before cPi is calculated indicate that the fluctuation of IMEP2 per combustion cycle in this period is small, while the fluctuation of IMEP1 per combustion cycle in this period is large. Accordingly, the result of determining that the combustion of the second cylinder 1022 is stable and the combustion of the first cylinder 1021 is unstable based on cPi1 and cPi2 described above is considered to be reasonable.

(3) The problem here is the transient state (transient operation) period presented in 80 to 180 cycles. In the period of this transient state, IMEP1 and IMEP2 have decreased due to presence of a transition from a state in which, for example, the engine speed and torque are large to a state in which they are small. The original waveform of the IMEP (see FIG. 5) indicates that, although both of the IMEP1 of the first cylinder 1021 and the IMEP2 of the second cylinder 1022 fluctuate because they are in the transient state, the combustion state is stable because the fluctuation is gentle. However, in FIG. 6, both cPi1 of the first cylinder 1021 and cPi2 of the second cylinder 1022 exceed 2, which is the set threshold value. Accordingly, with the method in which the combustion is judged to be unstable if the cPi is larger than the set threshold value (2 in this case), the combustion is judged to be unstable in the first cylinder 1021 and the second cylinder 1022 although the combustion is actually stable as described above.

As described above, in the present embodiment, attention is paid to a problem in a method of judging combustion stability based on a comparison between cPi and a set threshold value in a transient state such as the 80 to 180 cycles described above. In other words, an object of the present embodiment is to suppress combustion from being determined to be unstable despite the fact that the combustion is stable in a transient state, and to accurately determine the combustion stability even at the time of the transient state.

Next, the reason why combustion stability is determined to be unstable even though the combustion is stable in a transient state by using a method of judging combustion stability based on comparison between cPi and the set threshold value will be described in detail with reference to FIGS. 7 to 9.

Figure 7:
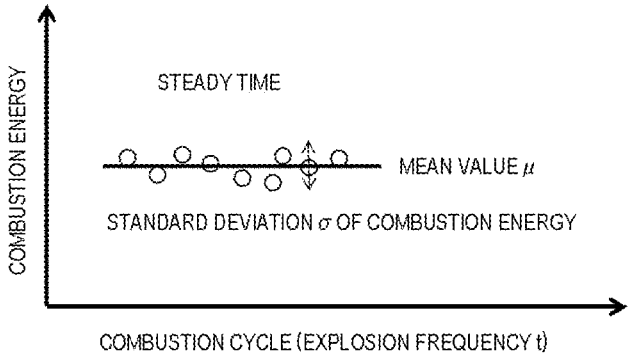
FIG. 7 is a chart illustrating a distribution and a mean value of combustion parameters at the time of the steady operation.

FIG. 7 illustrates distribution of IMEP (combustion energy) of a plurality of combustion cycles in a steady state (steady operation), the mean value μ of IMEP of the plurality of combustion cycles, and the standard deviation σ of the value of each IMEP from the mean value μ. As indicated in Equation 2 above, the parameter cPi at the time of the steady operation of the internal combustion engine 100 is calculated as a value obtained by dividing the standard deviation σ of the value of each IMEP from the mean value μ of IMEP at the set number of combustion cycles of several tens to hundred cycles in the past by the mean value μ.

Figure 8:
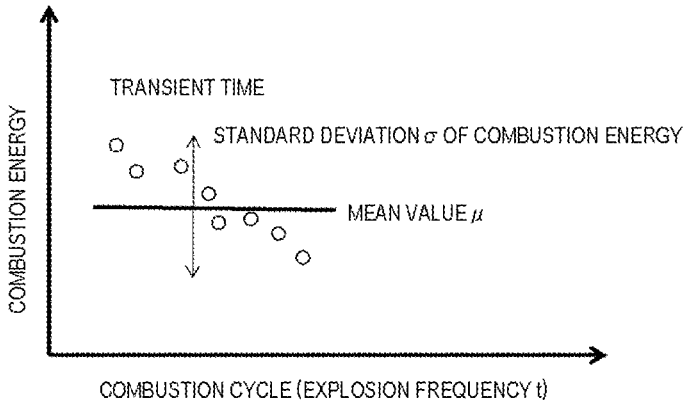
FIG. 8 is a chart illustrating a distribution and a mean value of combustion parameters at the time of the transient operation.

FIG. 8 illustrates distribution of IMEP in a plurality of combustion cycles in the transient state, its mean value μ, and the standard deviation σ from the mean value μ. As described above, cPi is calculated as a value obtained by dividing the standard deviation σ of the value of each IMEP from the mean value μ of IMEP at the set number of combustion cycles of several tens to hundred cycles in the past by the mean value μ. As described above, the transient state indicates a case where there is a transition from a state in which, for example, the engine speed and torque are large to a state in which they are small. That is, in this transient state, a gentle change occurs, such that the IMEP, which is the combustion energy, changes from a large value to a small value or vice versa, due to a fluctuation in the engine speed and torque, for example.

In spite of this gentle change, the mean value μ of the IMEP in the plurality of combustion cycles is a constant value, and hence the standard deviation σ of each IMEP from the mean value μ, which is the constant value, includes the effect of the gentle change and is larger than the actual combustion fluctuation. That is, in the transient state, cPi is calculated to be larger by the amount of the gentle change. Accordingly, combustion is always judged to be unstable in the transient state by using the method of judging combustion stability based on comparison between cPi and the set threshold value described above. In other words, this method has a problem that the combustion stability cannot be correctly judged.

Figure 9:
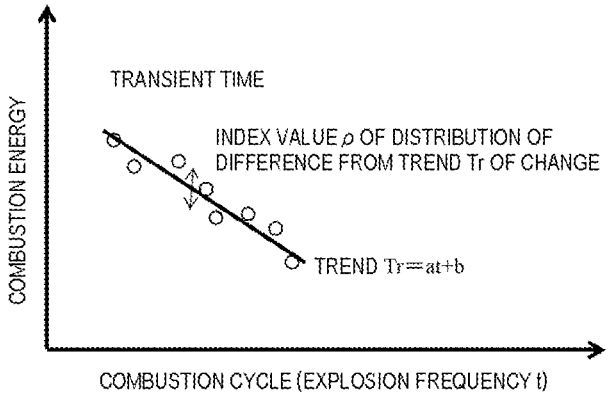
FIG. 9 is a chart illustrating a distribution of combustion parameters and a trend of change at the time of the transient operation.

Therefore, as illustrated in FIG. 9, in the present embodiment, attention is paid to the trend of change in a plurality of times of combustion energy (IMEP). This trend of combustion energy may be referred to as a combustion energy trend. That is, in the present embodiment, attention is paid to the distribution of a difference of combustion energy in each cycle not from the mean value μ of combustion energy at the time of the transient operation but from a straight line (approximate line) indicating the trend of change in combustion energy in a plurality of combustion cycles. The inventors of the present invention have made efforts and found that the combustion stability can be accurately evaluated by using the trend of change in the combustion energy.

Figure 10:
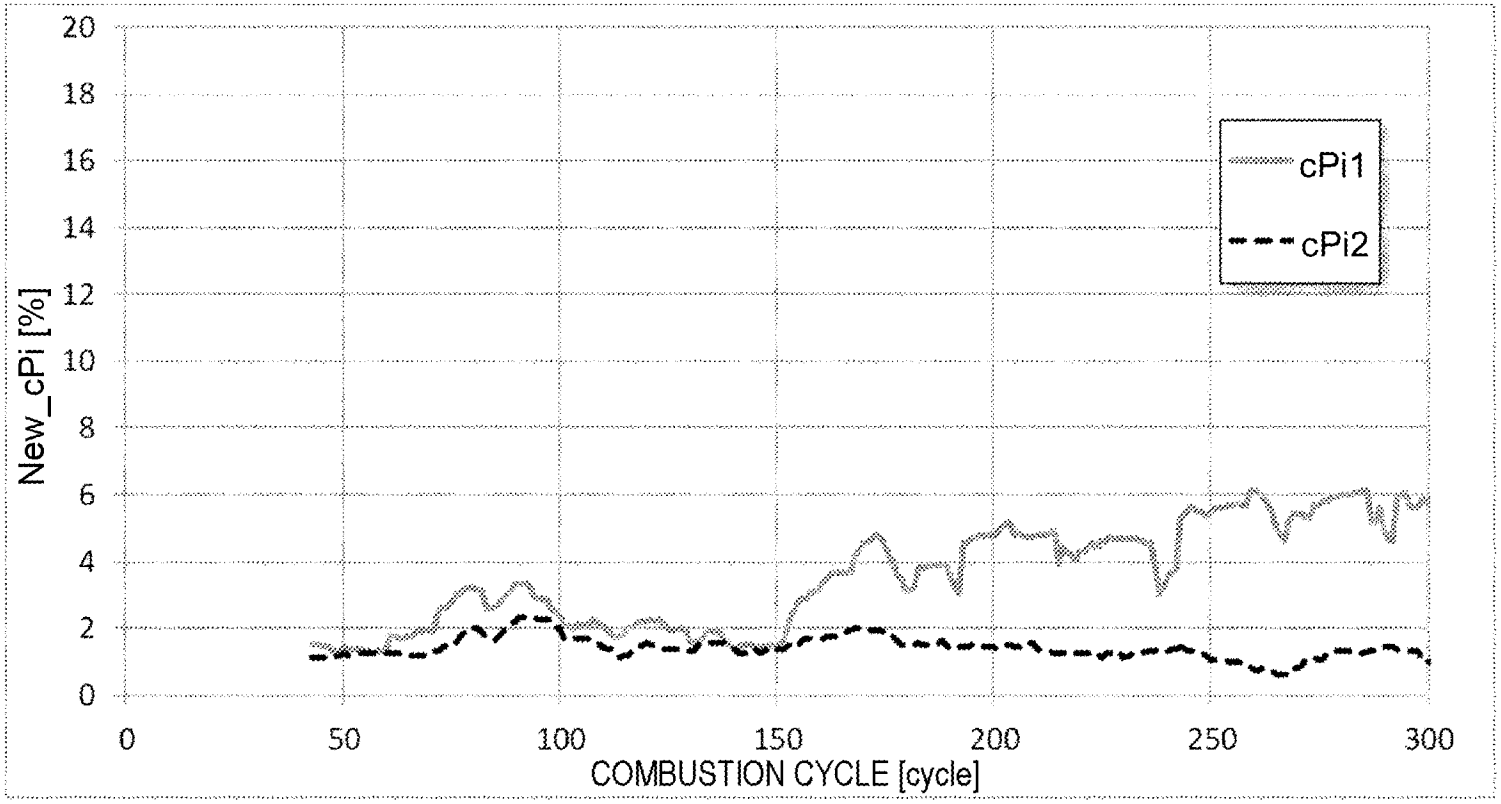
FIG. 10 is a graph illustrating a change in New_Cpi per combustion cycle in a predetermined cylinder.

FIG. 10 is a graph in which New_cPi is plotted. New_cPi is obtained by calculating an index value ρ of distribution of the difference from a straight line indicating a trend of change in combustion energy (IMEP) in a plurality of combustion cycles instead of the mean value μ of IMEP from the time series of the IMEP of FIG. 5 and dividing the index value ρ by the mean value μ. Thus, in the present embodiment, a judgment index of combustion stability is obtained using the index value ρ of distribution of the difference from a straight line indicating the trend of change in combustion energy in a plurality of combustion cycles.

As described above, since the combustion energy (IMEP) changes gently in the period of 80 to 180 cycles in the transient state in FIG. 5, the standard deviation σ of the value of each combustion energy from the mean value μ of the combustion energy described above increases, and it has been judged that the combustion is unstable.

On the other hand, according to the method of calculating the index value ρ of distribution of the difference from the trend of change in the combustion energy in the plurality of combustion cycles of the present embodiment, it is possible to correctly judge that the combustion is stable without being affected by the change due to transition even in such a transient state.

That is, according to the present embodiment, it is possible to accurately evaluate the combustion stability.

[Control Device Configuration]

Figure 11:
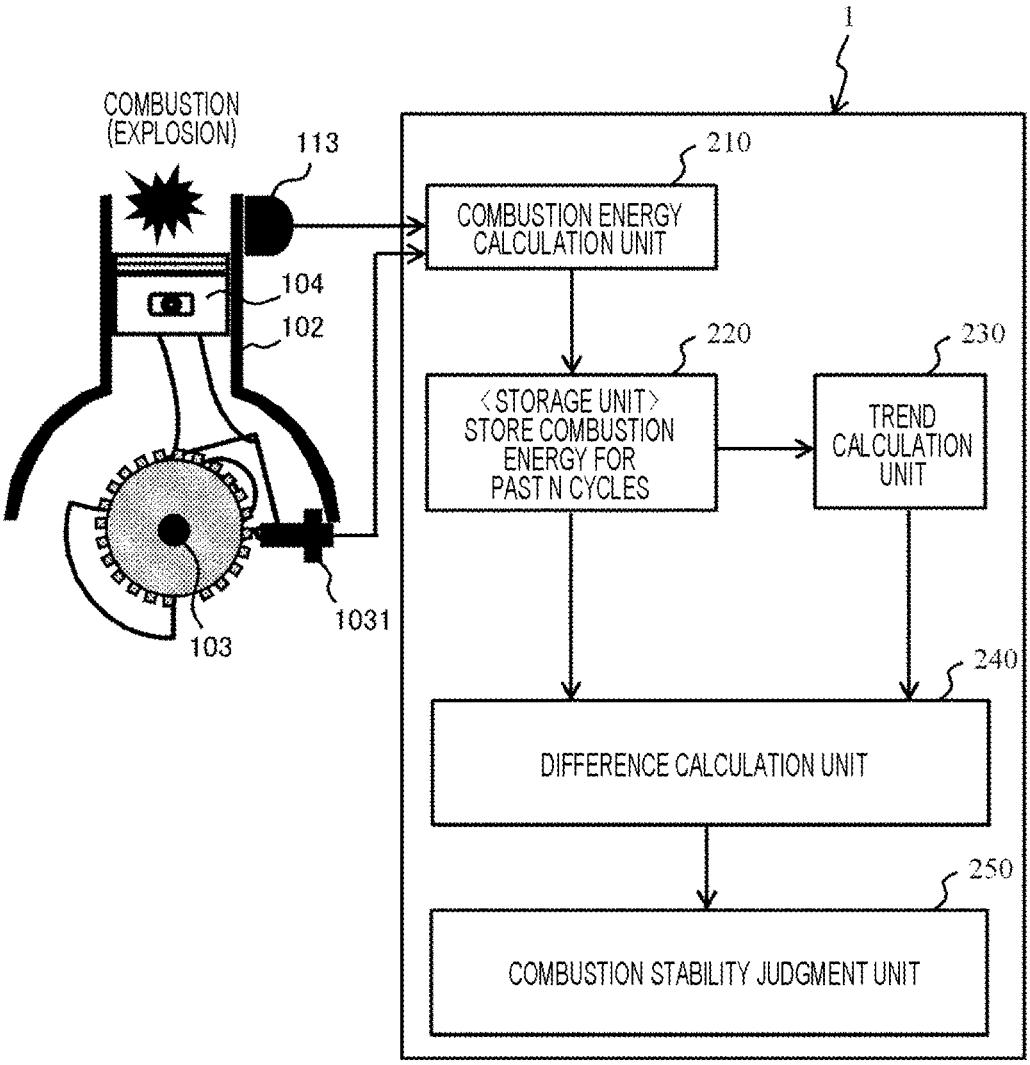
FIG. 11 is a diagram describing a configuration of a control device according to a first embodiment.

FIG. 11 illustrates the configuration of the control device 1 for realizing the evaluation of combustion stability of the present embodiment. Each block in the diagram of FIG. 11 is a functional block of the control device 1 of the present embodiment.

The control device 1 of the present embodiment has a combustion energy calculation unit 210 that calculates the combustion energy of each combustion cycle of the internal combustion engine 100. The cylinder pressure Pcyl detected by the cylinder pressure sensor 113 and the crank angle θ (may be referred to as a rotation angle) of the crankshaft 103 detected by the crank angle sensor 1031 are input to the combustion energy calculation unit 210 per combustion cycle.

The control device 1 of the present embodiment includes a trend calculation unit 230 that calculates a trend of change in the combustion energy calculated by the combustion energy calculation unit 210 in a plurality of combustion cycles, and a combustion stability judgment unit 250 that determines combustion stability based on the combustion energy in the plurality of combustion cycles and the trend of change calculated by the trend calculation unit 230.

The control device 1 of the present embodiment includes a difference calculation unit 240 that calculates a difference ε between the trend of change (Equation 5) in combustion energy in the plurality of combustion cycles calculated by the trend calculation unit 230 and the combustion energy per combustion cycle calculated by the combustion energy calculation unit 210 (combustion parameter calculation unit), and the combustion stability judgment unit 250 determines the combustion stability based on the difference ε. The combustion energy calculated by the combustion energy calculation unit 210 is stored in a storage unit 220 (memory), and the trend calculation unit 230 and the combustion stability judgment unit 250 implement the above content using each combustion energy in the plurality of combustion cycles stored in the storage unit 220.

[Determination Method by Control Device]

Next, a judgment method for the combustion state of the present embodiment will be described in the light of the configuration of the control device 1 described above.

Figure 12:
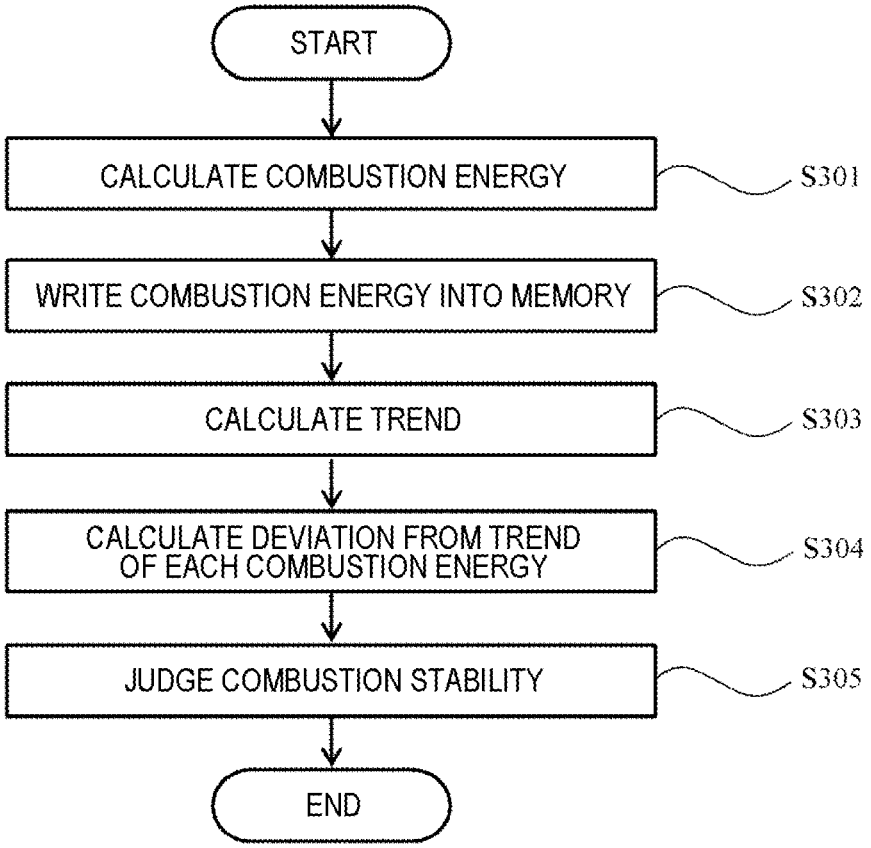
FIG. 12 is a flowchart of a judgment method for a combustion state by the control device according to the first embodiment.

FIG. 12 is a flowchart of the determination method for the combustion state by the control device 1. First, in step S301, the combustion energy calculation unit 210 starts calculation of the combustion energy in a case where the piston 104 is at the position of the top dead center (TDC) in the intake stroke based on the crank angle θ (rotation angle) of the crankshaft 103 detected by the crank angle sensor 1031. Then, the combustion energy calculation unit 210 initializes the combustion energy in the case of TDC in the intake stroke as in Equation 3 below.

$$W=O \quad \text{[Equation 3]}$$

The combustion energy is calculated based on Equation 1 described above. If Equation 1 is expressed in discrete time, the combustion energy can be expressed by Equation 4 below. In Equation 1, IMEP, which is combustion energy, is used as one of the combustion parameters.

$$W=W_\text{old}+P\text{cyl}\times\Delta V \quad \text{[Equation 4]}$$

The combustion energy calculation unit 210 detects the cylinder pressure Pcyl per cylinder 102 by the cylinder pressure sensor 113 per falling timing of an output signal of the crank angle sensor 1031, and calculates an increase amount ΔV of the volume V in the cylinder 102 from the change of the crank angle θ. Then, the combustion energy calculation unit 210 calculates the combustion energy per falling timing of the output signal of the crank angle sensor 1031 by adding the product of the cylinder pressure Pcyl and the increase amount ΔV of the volume V in the cylinder 102 to a work amount W_old calculated at the falling timing of the previous output signal of the crank angle sensor 1031.

In step S302, the combustion energy calculation unit 210 calculates the combustion energy for one combustion cycle while the crank angle θ changes from the position of TDC in the intake stroke in which the calculation of the combustion energy is started to the position of TDC in the intake stroke after 720 degrees (two rotations of the crankshaft).

When this is detected by an output signal from the crank angle sensor 1031, the calculation of the combustion energy is finished, and the calculated combustion energy for one combustion cycle is stored in the storage unit 220.

The storage unit 220 stores combustion energy W_t of past several combustion cycles to several tens of combustion cycles. W_t indicates the IMEP (combustion energy) in the t-th combustion cycle obtained by the above method.

In step S303, the trend calculation unit 230 calculates the trend of change in the combustion energy based on the distribution of the combustion energy W_t of the past several combustion cycles to several tens of combustion cycles stored in the storage unit 220. Assuming that the combustion energy is plotted in the order of combustion cycles as in FIG. 9, a trend Tr of change in combustion energy is given by Equation 5 below.

$$Tr=at+b \quad \text{[Equation 5]}$$

Then, by obtaining a and b in Equation 5, the trend calculation unit 230 calculates the trend Tr of change in the combustion energy (IMEP). That is, the trend Tr of change in the combustion energy is an index indicating how the combustion energy changes in the distribution of the combustion energy illustrated in FIG. 5, and in other words, it is an approximate expression in a case where the distribution of the combustion energy illustrated in FIG. 5 is approximated by a straight line or the like. It can be said that the trend calculation unit 230 calculates the trend of change in the combustion energy by approximating the distribution of the combustion energy in a plurality of combustion cycles by a linear function. Coefficients a and b of the trend Tr of change in the combustion energy can be calculated by using the least square method for the distribution of the combustion energy W_t in the several combustion cycles to several tens of combustion cycles illustrated in FIG. 5, for example. That is, Equation 5 expresses the distribution of the combustion energy in the plurality of combustion cycles as an approximate expression of a linear function, which can be said to indicate the trend of change in the combustion energy.

Next, in step S304, the difference calculation unit 240 calculates a difference ε_t from the trend Tr of change in the combustion energy W_t calculated per combustion cycle in the several combustion cycles to several tens of combustion cycles, based on Equation 6 below. The difference ε_t is obtained for each of the plurality of combustion cycles, and it is possible to evaluate the distribution of the combustion energy W_t in consideration of the trend Tr of change in the combustion energy.

$$\varepsilon_{_t}=W_{_t}-at-b \quad \text{[Equation 6]}$$

Then, in step S305, the difference calculation unit 240 calculates the sum of the squares of the differences ε in the several combustion cycles to several tens of combustion cycles, with Equation 7 below using the difference ε_t of the combustion energy W_t calculated in step S304. In Equation 7, T represents the number of combustion cycles for judging the combustion stability. That is, Equation 7 can be said to be the sum of the squares of the differences ε from the trend Tr of change in the combustion energy W_t in consideration of the trend Tr of change in the combustion energy in the plurality of combustion cycles.

$$\sum_{t=1}^{T}\varepsilon_{_t}^2 \quad \text{[Equation 7]}$$

The combustion stability judgment unit 250 performs a stability judgment of the combustion state of the internal combustion engine 100 based on the sum of the squares of the differences ε from the trend Tr of change in the combustion energy W_t in the plurality of combustion cycles calculated by Equation 7 described above, and ends the processing. That is, the combustion stability judgment unit 250 judges the combustion stability based on the difference ε calculated by the difference calculation unit 240 described above. Specifically, the combustion stability judgment unit 250 compares the sum of the squares of the differences ε from the trend Tr of change in the combustion energy W_t in the plurality of combustion cycles calculated with Equation 7, or the quotient obtained by dividing the sum by a number T of combustion cycles, with a set threshold value set in advance. If the sum of the squares of the differences ε or the quotient obtained by dividing the sum by the number T of combustion cycles is equal to or less than the set threshold value, the combustion stability judgment unit 250 judges that the combustion is stable in the plurality of combustion cycles. Conversely, if the sum of the squares of the differences ε exceeds the set threshold value, the combustion stability judgment unit 250 judges that the combustion is unstable. The sum of the squares of the differences ε from the trend Tr of change in the combustion energy W_t in the plurality of combustion cycles calculated with Equation 7 or the quotient obtained by dividing the sum by the number T of combustion cycles varies depending on the engine load, and it is hence necessary to change the set threshold value here depending on the engine load.

The combustion stability of the internal combustion engine 100 may be judged (evaluated) based on values calculated based on Equations 8 to 10 below, instead of the sum of the differences ε calculated based on Equation 7 described above. Here, a deviation ρ of Equation 8 is obtained by dividing the sum (Equation 7) of the squares of the differences ε from the trend Tr of change in the combustion energy W_t in the plurality of combustion cycles by the number T of combustion cycles, and calculating the square root of the quotient. The mean value μ of Equation 9 is obtained by calculating the sum of the combustion energy W_t in the plurality of combustion cycles described above, and dividing the calculated sum by the number T of combustion cycles. New_cPi in Equation 10 is obtained by dividing the index value ρ of the distribution of the differences ε in Equation 8 by the mean value μ in Equation 9. The present invention can be realized also by setting a set threshold value for judging the combustion stability with respect to New_cPi in Equation 10.

In this case, the combustion stability judgment unit 250 compares New_cPi in Equation 10 with the set threshold value set in advance. The combustion stability judgment unit 250 judges that the combustion is stable in the plurality of combustion cycles if New_cPi is equal to or less than the set threshold value, and, conversely, judges that the combustion is unstable if New_cPi exceeds the set threshold value.

$$\sigma=\sqrt{\frac{\sum_{t=1}^{T}\varepsilon_{_t}^2}{T}} \quad \text{[Equation 8]}$$

$$\mu=\frac{\sum_{t=1}^{T}W_{_t}}{T} \quad \text{[Equation 9]}$$

$$\text{New_cPi}=\frac{\sigma}{\mu} \quad \text{[Equation 10]}$$

As described above, FIG. 10 is a graph in which New_cPi obtained using Equations 8 to 10 is plotted corresponding to the time series of the IMEP of FIG. 5. Thus, according to the present embodiment, it is possible to correctly judge that the combustion state is stable because New_cPi of the combustion energy W_t is small in the transient state and in the period of 80 to 180 cycles in which the combustion state is stable. Therefore, according to the present embodiment, it is possible to accurately judge the combustion stability even in the transient state.

Second Embodiment

Hereinafter, a second embodiment of the present invention will be described with reference to the drawings. Equation 2 described in the first embodiment or the parameter cPi described in FIG. 6 represents the quotient obtained by dividing the index value ρ of distribution of difference from the mean value μ by the mean value μ, as described in FIG. 7 or 8. That is, in Equation 2, FIG. 6, 7, or 8, the combustion stability is evaluated based on the value calculated by Equation 11 below. This Equation 11 calculates the difference of the combustion energy W_t calculated per combustion cycle in the plurality of combustion cycles from the mean value μ of the combustion energy in the plurality of combustion cycles, and expresses the sum of the squares of the differences in the plurality of combustion cycles T. That is, since it is the difference from the mean value μ, the trend Tr of change in the combustion energy W_t is not considered.

$$\sum_{t=1}^{T}(W_{_t}-\mu)^2 \qquad \text{[Equation 11]}$$

Hereinafter, the relationship between the combustion stability based on Σ(ε_t)^2 (Equation 7), where the effect of the trend Tr of change in the combustion energy W_t proposed in the first embodiment is removed, and the combustion stability based on Σ(W_t−μ)^2, where the effect of the trend Tr of change that has been performed with cPi expressed by Equations 2 and 11 will be discussed below. In Equation 6 described above, ε_t on the left side is set to 0, and the mean of the right side is obtained, thereby giving Equation 12 below.

$$0=\mu-a\frac{T+1}{2}-b \qquad \text{[Equation 12]}$$

Subtracting the both sides of Equation 12 from the both sides of Equation 6 described above gives Equation 13 below.

$$W_{_t}-\mu=\varepsilon_{_t}+a\left(t-\frac{T+1}{2}\right) \qquad \text{[Equation 13]}$$

Hence, the total sum of the combustion cycles t=1 to T in Equation 13 can be expressed by Equation 14 below.

T indicates the number of combustion cycles for judging the combustion stability.

$$\sum_{t=1}^{T}(W_{_t}-\mu)^2=\sum_{t=1}^{T}\left\{\varepsilon_{_t}+a\left(t-\frac{T+1}{2}\right)\right\}^2 \qquad \text{[Equation 14]}$$

Since ε_t and a×{t−(T+1)/2} are independent from each other in Equation 14 described above, Equation 15 below is derived.

$$\sum_{t=1}^{T}(W_{_t}-\mu)^2=\sum_{t=1}^{T}\varepsilon_{_t}^2+a^2\sum_{t=1}^{T}\left(t-\frac{T+1}{2}\right)^2 \qquad \text{[Equation 15]}$$

In Equation 15, the sum of the squares of the differences ε from the trend Tr of change in the combustion energy W_t in the plurality of combustion cycles expressed in Equation 7 is expressed in the first term on the right side of Equation 15. The left side of Equation 15 is the sum of the squares of the difference of the combustion energy W_t from the mean value μ of the combustion energy W_t (IMEP) in the plurality of combustion cycles expressed in Equation 11, which is an index of the distribution from the mean value μ. Furthermore, the second term on the right side of Equation 15 expresses an equation obtained by multiplying the square of a slope a of the trend Tr of change in the combustion energy W_t by a constant using a period (number of combustion cycles for combustion stability judgment) T for calculating the trend of change in the combustion energy.

From the above, the sum (first term on the right side of Equation 15) of the square of the difference ε from the trend Tr of change in the combustion energy W_t in the plurality of combustion cycles expressed by Equation 7 can be obtained by subtracting the value (second term on the right side of Equation 15) based on the constant obtained from the slope a of the trend Tr of change in the combustion energy W_t and the number T of combustion cycles from the index (left side of Equation 15, Equation 11) of the distribution of the combustion energy W_t from the mean value μ of the combustion energy W_t (IMEP) in the plurality of combustion cycles.

In the light of this, the means for solving the problem in the present embodiment will be described below.

[Control Device Configuration]

Figure 13:
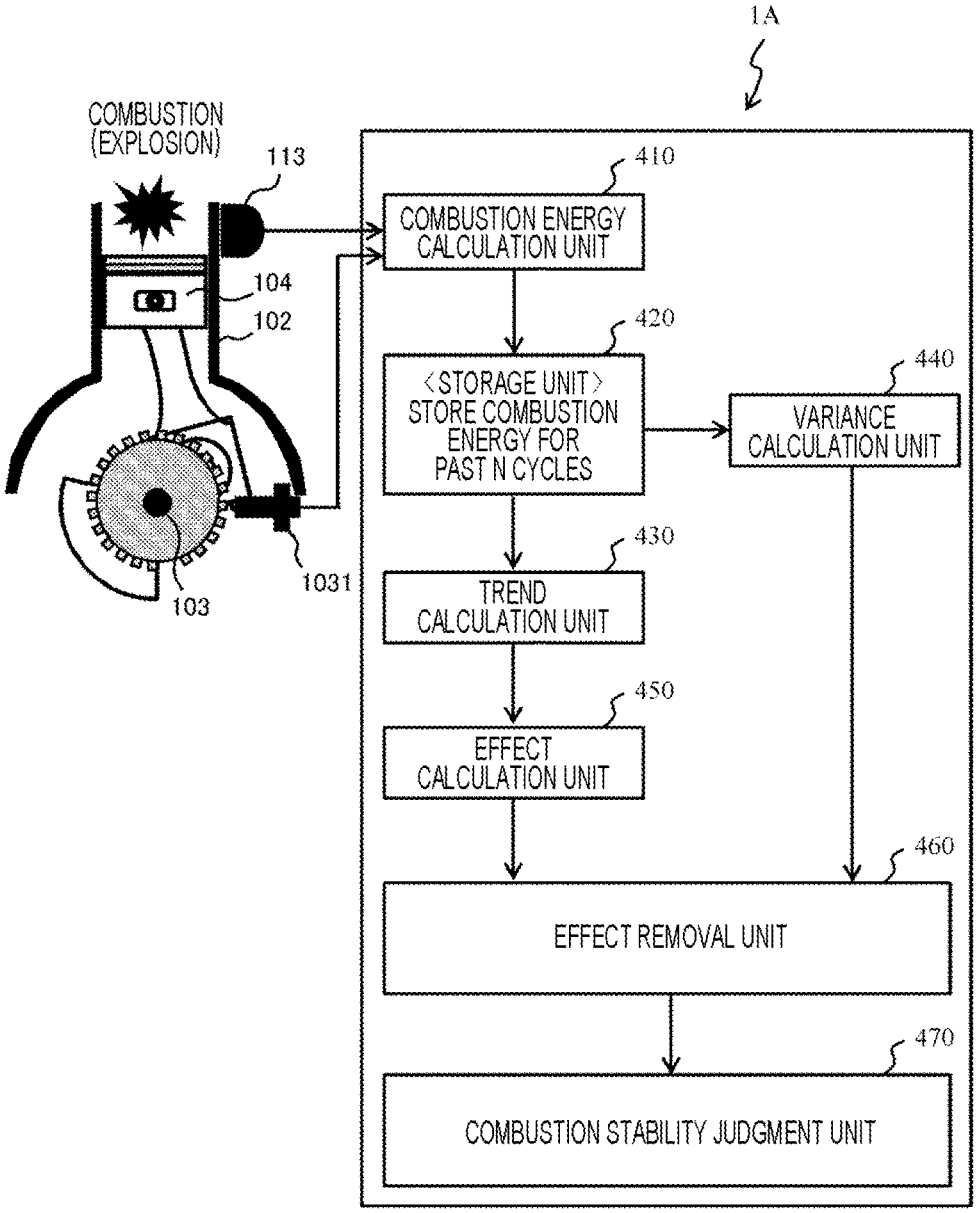
FIG. 13 is a diagram describing a configuration of a control device according to a second embodiment.

FIG. 13 illustrates the configuration of a control device 1A for realizing the evaluation of combustion stability of the present embodiment. Each block in the diagram of FIG. 13 is a functional block of the control device 1A of the present embodiment.

The control device 1A of the present embodiment has a combustion energy calculation unit 410 that calculates the combustion energy of each combustion cycle of the internal combustion engine 100, and a trend calculation unit 430 that calculates a trend of change in the combustion energy calculated by the combustion energy calculation unit 410 in a plurality of combustion cycles. The control device 1A of the present embodiment has a variance calculation unit 440 that calculates a variance of the combustion energy based on the combustion energy (IMEP) in the plurality of combustion cycles, and a combustion stability judgment unit 470 that judges the combustion stability based on the trend of change in the combustion energy in the plurality of combustion cycles calculated by the trend calculation unit 430 and the variance of the combustion energy (IMEP) calculated by the variance calculation unit 440.

Hereinafter, a judgment method for a combustion state by the control device 1A will be described with reference to the flowchart of FIG. 14.

[Judgment Method by Control Device]

Figure 14:
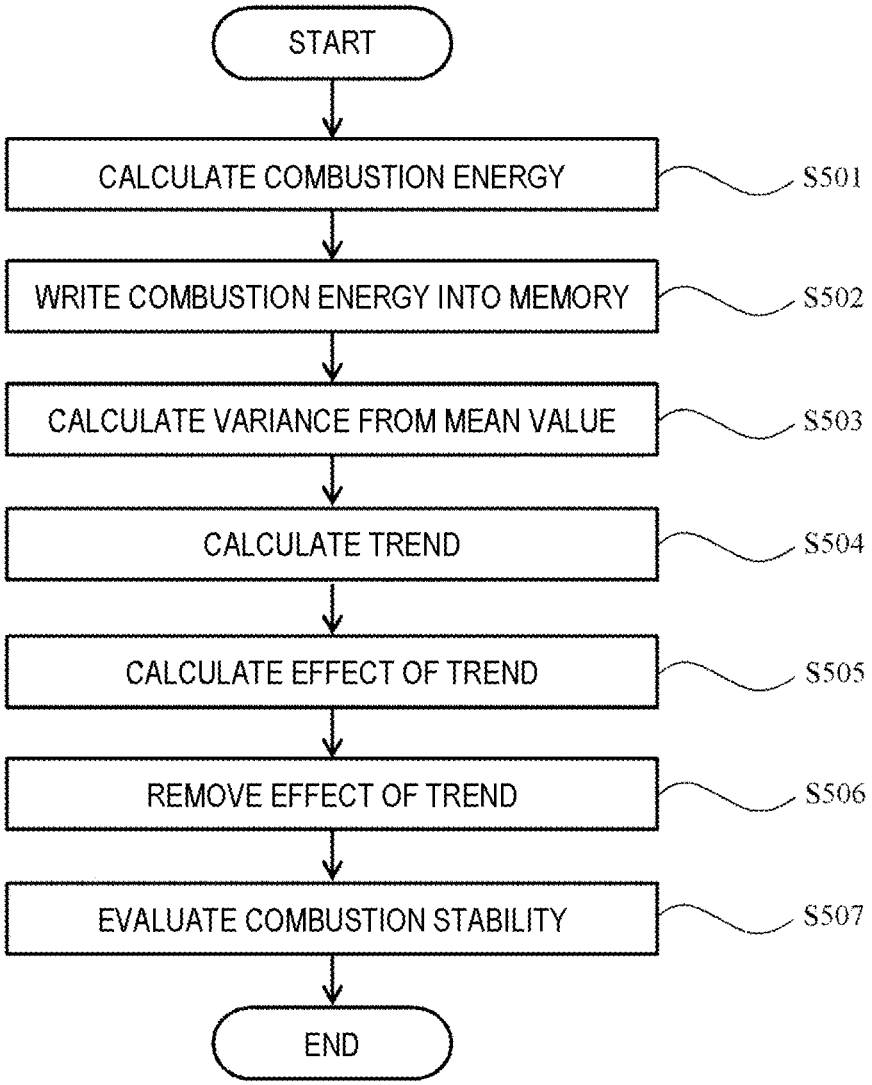
FIG. 14 is a flowchart of a judgment method for a combustion state by the control device according to the second embodiment.

First, in step S501 of FIG. 14, the combustion energy calculation unit 410 starts calculation of the combustion energy in the case where the piston 104 is at the position of TDC in the intake stroke based on the crank angle θ (rotation angle) of the crankshaft 103 detected by the crank angle sensor 1031. Since the combustion energy calculation method by the combustion energy calculation unit 410 is the same as the combustion energy calculation method by the combustion energy calculation unit 210 of the first embodiment (see step S301 of FIG. 12), a detailed description will be omitted.

In step S502, when detecting that the crank angle θ is the TDC of the intake stroke that is 720 degrees after the TDC of the intake stroke in which the calculation of the combustion energy is started, the combustion energy calculation unit 410 calculates the combustion energy for one combustion cycle and finishes the calculation of the combustion energy.

The combustion energy calculated by the combustion energy calculation unit 410 is stored in a storage unit 420 (memory). The storage unit 420 stores combustion energy of past several cycles to several tens of cycles.

In step S503, the variance calculation unit 440 calculates the variance (quotient obtained by dividing the left side of Equation 11 or 15 by T), from the mean value μ, of the combustion energy of the plurality of past combustion cycles stored in the storage unit 420. That is, the variance calculation unit 440 obtains the difference of the combustion energy W_t calculated per combustion cycle in the plurality of combustion cycles from the mean value μ of the combustion energy W_t in the plurality of combustion cycles, and obtains the mean value of the square of the difference in the plurality of combustion cycles. Equation 16 expresses the square root (standard deviation σ) of the quotient obtained by dividing the sum of the values on the left sides of Equations 11 and 15 by the number T of times of a plurality of combustion cycles. Dividing the value of Equation 16 by the mean value μ gives cPi described in the first embodiment.

[Equation 16]

$$\sigma = \sqrt{\frac{\sum_{t=1}^{T} (W_{_t} - \mu)^2}{T}}$$

In step S504, the trend calculation unit 430 calculates the trend Tr of change in the combustion energy W_t in the plurality of combustion cycles based on the distribution of the combustion energy W_t in the plurality of past combustion cycles stored in the storage unit 420. The calculation method of the trend Tr of change in the combustion energy W_t by the trend calculation unit 430 is the same as the calculation method of the trend Tr of change in the combustion energy W_t by the trend calculation unit 230 of the first embodiment (see step S303 of FIG. 12). That is, the trend calculation unit 430 represents the distribution of the combustion energy W_t in the plurality of combustion cycles illustrated in FIG. 10 as an approximate expression (at+b) of the primary straight line by using the least square method, and calculates the coefficients a and b, thereby obtaining the trend Tr of change in the combustion energy W_t in the plurality of combustion cycles.

In step S505, an effect calculation unit 450 calculates an effect of the trend Tr of change in the combustion energy W_t on the variance of the combustion energy W_t based on the slope a of the trend Tr of change in the combustion energy W_t calculated by the trend calculation unit 430 and the number T of combustion cycles in a period for calculating the trend Tr of change in the combustion energy W_t. Specifically, the effect calculation unit 450 can calculate the effect of the trend Tr of change in the combustion energy W_t on the variance of the combustion energy W_t by obtaining the right side second term of Equation 15.

In step S506, an effect removal unit 460 removes the effect of the trend Tr of change in the combustion energy W_t calculated by the effect calculation unit 450 in step S505 on the variance of the combustion energy W_t from the quotient (variance of the combustion energy W_t) obtained by dividing the sum of the squares of the differences from the mean value μ of the combustion energy W_t in the plurality of combustion cycles calculated by the variance calculation unit 440 in step S503 by T. Specifically, the effect removal unit 460 calculates the quotient obtained by dividing the sum of the squares of the differences ε from the trend Tr of change in the combustion energy W_t in the plurality of combustion cycles by T based on Equation 17 below.

In other words, the effect removal unit 460 removes the effect of the trend Tr of change in the combustion energy W_t by subtracting a contribution (a^2*(Σ(t−(T+1)/2)^2)/T) due to the trend Tr of change in the combustion energy W_t calculated by the effect calculation unit 450 from a variance ((Σ(W_t−μ)^2)/T) from the mean value μ of the combustion energy W_t in the plurality of combustion cycles calculated by the variance calculation unit 440. With this configuration, the effect removal unit 460 can calculate an index value (Σ(ε_t^2)/T) of the distribution of the combustion energy W_t from which the effect of the trend Tr of change in the combustion energy W_t has been removed.

[Equation 17]

$$\frac{\sum_{t=1}^{T} \varepsilon_{_t}^2}{T} = \frac{\sum_{t=1}^{T} (W_{_t} - \mu)^2}{T} - \frac{a^2 \sum_{t=1}^{T} \left(t - \frac{T+1}{2}\right)^2}{T}$$

Equation 17 matches Equation 7 described in the first embodiment. Therefore, Equation 17 realizes the calculation equivalent to Equation 7 described in the first embodiment from another viewpoint. Thus, in step S507, the combustion stability judgment unit 470 judges the combustion stability based on the index value Σ(ε_t^2) of the distribution of the combustion energy W_t from which the effect of the trend Tr of change in the combustion energy W_t has been removed by the effect removal unit 460 or the quotient (Σ(ε_t^2)/T) obtained by dividing the index value Σ(ε_t^2) by the combustion cycle T. Since this method is the same as that of the first embodiment, detailed description thereof will be omitted. As described above, at the time of the transient operation of the internal combustion engine 100, the combustion stability judgment unit 470 can appropriately evaluate the combustion stability based on the index value of the distribution of the combustion energy W_t after removing the effect of the trend of change in the combustion energy (see FIG. 10). Furthermore, in the present embodiment, the combustion stability can be evaluated by calculating Equation 17, and thus the calculation amount is smaller than that in the calculations of Equations 6 and 7 in the first embodiment. Therefore, the present invention can be realized even if the performance of a microcomputer of the control device is not high.

It is possible to obtain New_cPi by Equations 8 to 10 based on the index value ($\Sigma(\varepsilon_t\hat{}2)/T$) of the distribution of combustion energy excluding the contribution due to the trend of change in the combustion energy obtained by Equation 17. However, the description thereof is omitted because this method is the same as that of the first embodiment. In the first and second embodiments, the case in which the trend Tr of change in the combustion energy at the time of the transient operation of the internal combustion engine 100 is calculated to perform the stability evaluation of the combustion state at the time of the transient operation has been described as an example. However, the control device 1, 1A may perform the stability evaluation of the combustion state after calculating the trend of change in the combustion energy also at the time of the steady operation.

Third Embodiment

Hereinafter, a third embodiment of the present invention will be described with reference to the drawings. The object of the first and second embodiments is to correctly evaluate the distribution from change in the combustion energy W_t in the plurality of set times of combustion cycles. However, there is also a demand to detect a sudden change in the combustion energy W_t in one combustion cycle.

Figure 15:
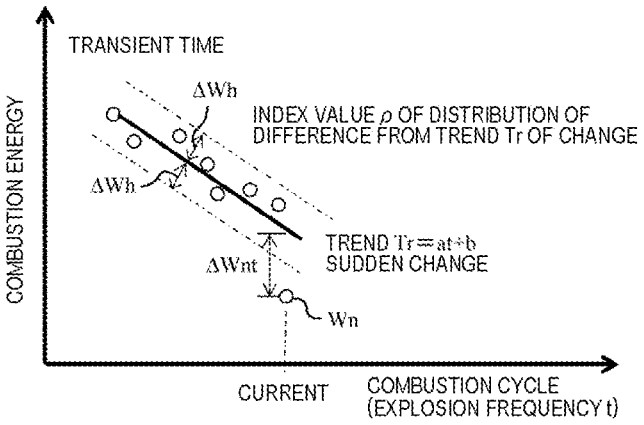
FIG. 15 is a chart illustrating a distribution of combustion parameters, a trend of change, and a sudden change in combustion at the time of the transient operation according to a third embodiment.

FIG. 15 is a chart for describing a state in which a sudden change occurs in the combustion energy at the time of the transient operation according to the present embodiment. The trend Tr of change in the combustion energy W_t in the plurality of combustion cycles is obtained from the distribution of the combustion energy in the first and second embodiments. Therefore, in the present embodiment, a method for detecting a sudden combustion change using the trend Tr of the change will be described.

[Control Device Configuration]

Figure 16:
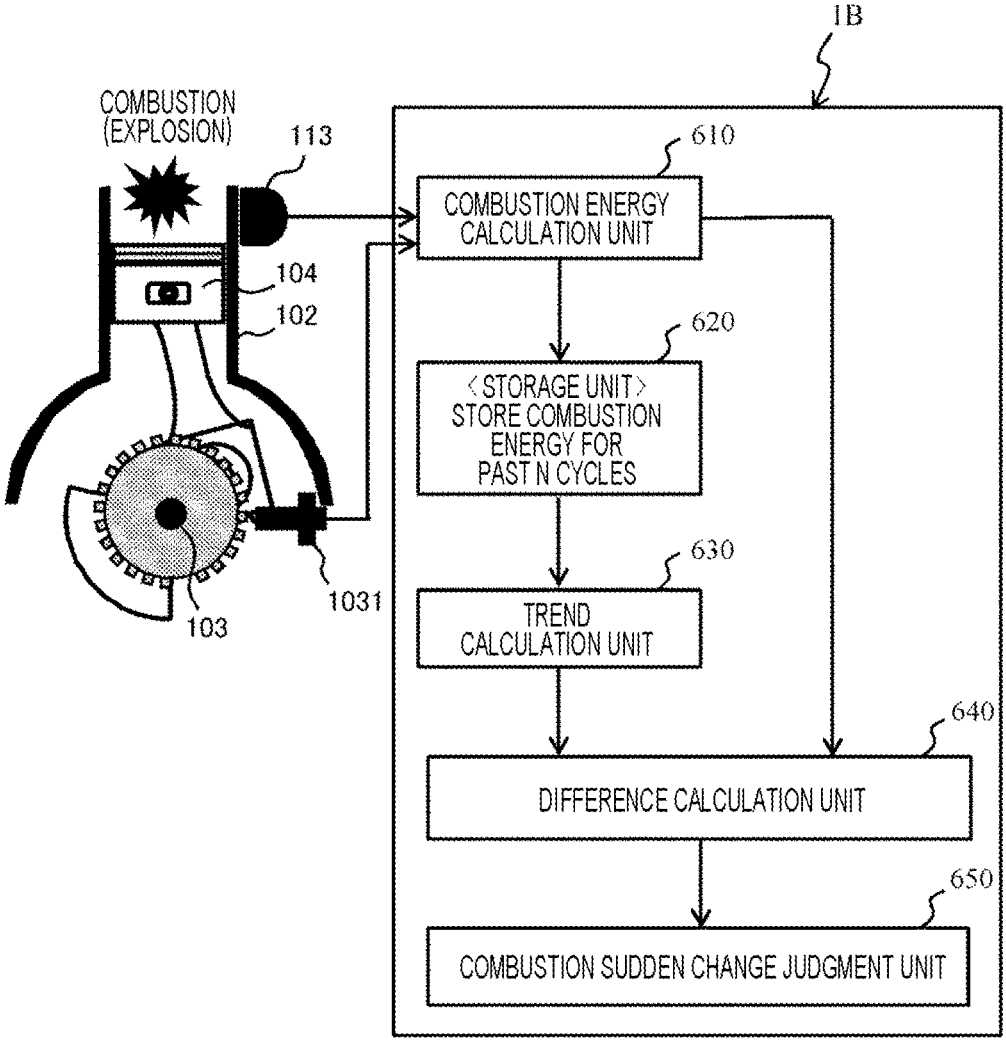
FIG. 16 is a diagram describing a configuration of a control device according to the third embodiment.

FIG. 16 illustrates the configuration of a control device 1B for detecting a sudden combustion change according to the present embodiment. Each block in the diagram of FIG. 16 is a functional block of the control device 1B of the present embodiment.

Similarly to the first and second embodiments, the control device 1B of the present embodiment has a combustion energy calculation unit 610 that calculates the combustion energy of each combustion cycle of the internal combustion engine 100, a storage unit 620 that stores the combustion energy of a plurality of past combustion cycles, and a trend calculation unit 630 that calculates a trend of change in the combustion energy calculated by the combustion energy calculation unit 610 in the plurality of combustion cycles.

[Judgment Method by Control Device]

Figure 17:
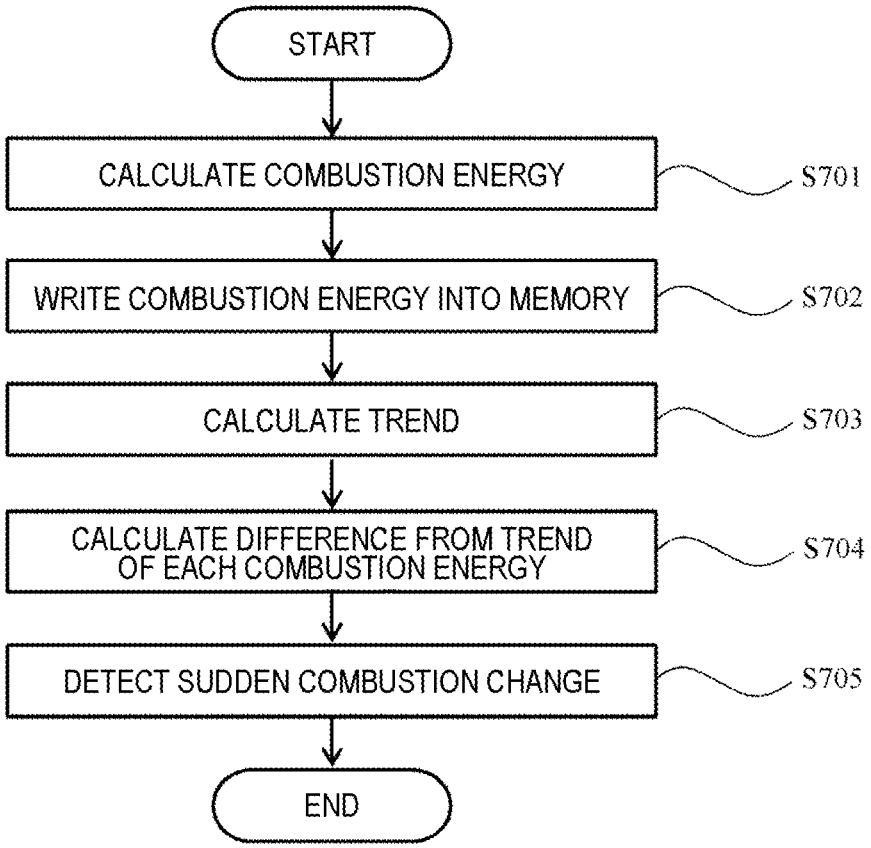
FIG. 17 is a flowchart of a judgment method for a combustion state by the control device according to the third embodiment.

Hereinafter, a judgment method for a sudden combustion change by the control device 1B of the present embodiment will be described. FIG. 17 is a flowchart of a judgment method for a combustion state by the control device 1B. First, in step S701, the combustion energy calculation unit 610 starts calculation of the combustion energy in the case where the piston 104 is at the position of TDC in the intake stroke based on the crank angle θ (rotation angle) of the crankshaft 103 detected by the crank angle sensor 1031. The calculation method for the combustion energy by the combustion energy calculation unit 610 is the same as that in the first and second embodiments, and hence the description thereof is omitted.

In step S702, when detecting that the crank angle θ is the TDC of the intake stroke that is 720 degrees after the TDC of the intake stroke in which the calculation of the combustion energy is started, the combustion energy calculation unit 610 calculates the combustion energy for one combustion cycle and finishes the calculation of the combustion energy.

The calculated combustion energy for one combustion cycle is stored in the storage unit 620, and the storage unit 620 stores combustion energy of past several cycles to several tens of cycles.

In step S703, the trend calculation unit 630 calculates the trend Tr of change in the combustion energy based on the distribution of the combustion energy W_t in the plurality of past combustion cycles (several times to several ten times) stored in the storage unit 620. The calculation method for the trend Tr of change in the combustion energy by the trend calculation unit 630 is the same as the calculation method for the trend of change in the combustion energy by the trend calculation unit described in the first and second embodiments, and hence the description thereof is omitted.

In step S704, a difference calculation unit 640 calculates a difference ΔW_t (at+b−Wn) between the trend Tr (at+b) of change in the combustion energy calculated by the trend calculation unit 630 in step S703 and the combustion energy W_t calculated by the combustion energy calculation unit 610 in step S701.

Then, in step S705, a combustion sudden change judgment unit 650 (may be referred to as a sudden fluctuation evaluation unit) judges whether the difference ΔW_t (at+b−Wn) calculated by the difference calculation unit 640 in step S704 exceeds a set threshold value ΔWh. When judging that the difference ΔW_t (at+b−Wn) exceeds the set threshold value ΔWh (ΔW_t (at+b−Wn)>ΔWh), the combustion sudden change judgment unit 650 judges that combustion energy in the combustion cycle suddenly has changed. On the other hand, when judging that the difference ΔW_t is equal to or less than the set threshold value ΔWh (ΔW_t (at+b−Wn)≤ΔWh), the combustion sudden change judgment unit 650 determines that there is no sudden change in the combustion energy in the combustion cycle. This makes it possible to evaluate sudden fluctuations in the combustion energy.

While the above embodiments have been described based on variations in the combustion energy for the stability evaluation of the combustion state by the control devices 1, 1A, 1B, the combustion parameters for the stability evaluation of the combustion state are not limited thereto.

Figure 18:
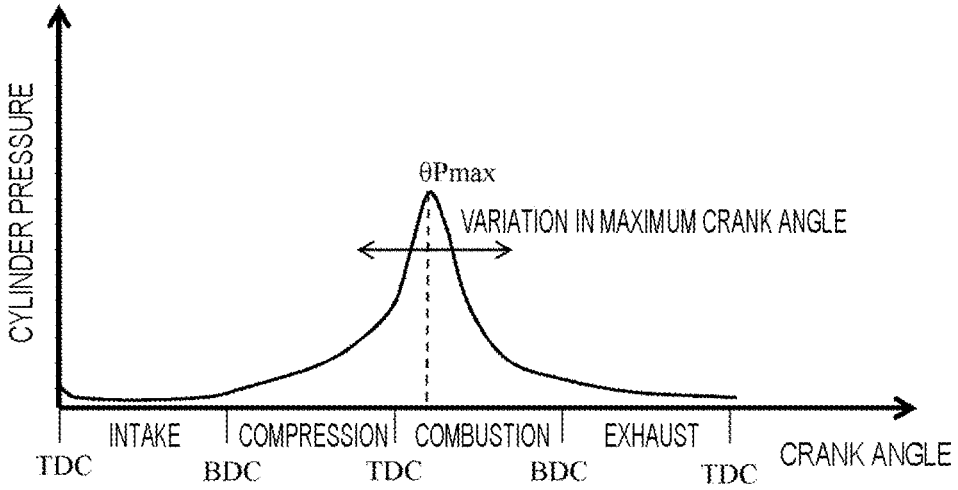
FIG. 18 is a graph illustrating the relationship between the crank angle and the cylinder pressure in the cylinder of the internal combustion engine.

FIG. 18 is a graph illustrating a change in cylinder pressure in one combustion cycle. Here, assuming that the combustion becomes maximum at a crank angle θPmax at which the cylinder pressure becomes maximum, the stability of the combustion state can be evaluated based on a distribution width of the crank angle θPmax. When the combustion state of the cylinder of the internal combustion engine 100 is stable, the distribution width of the crank angle θPmax at which combustion becomes maximum falls within a predetermined set range. On the other hand, when the combustion state of the internal combustion engine 100 is unstable, the distribution width of the crank angle θPmax at which combustion becomes maximum exceeds the predetermined set range.

Accordingly, the combustion stability judgment unit (250, 470) of the control device (1, 1A, 1B) can judge (evaluate) the stability of the combustion state of the internal combustion engine 100 based on the distribution width of the crank angle θPmax, at which the combustion becomes maximum, as an evaluation parameter. θPmax is also referred to as a combustion timing. By thus paying attention to the combustion timing, it is possible to correctly judge (evaluate) the stability of the combustion state also in the transient state as in the first and second embodiments.

Figure 19:
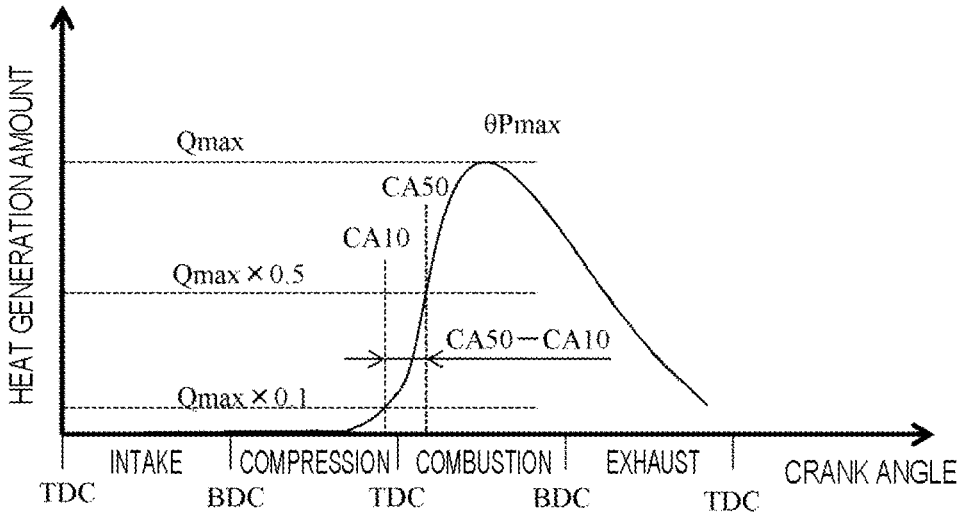
FIG. 19 is a graph illustrating the relationship between the crank angle and a heat generation amount in the cylinder of the internal combustion engine.

FIG. 19 illustrates the relationship between a heat amount Q in one combustion cycle and a corresponding crank angle. CA10 is a crank angle at the timing when the combustion ratio becomes 10% with respect to the maximum, that is, the heat amount is generated at a ratio of 10% with respect to a maximum value Qmax of the heat generation amount.

CA50 is a crank angle at the timing when the combustion ratio becomes 50% with respect to the maximum, that is, the heat amount is generated at a ratio of 50% with respect to the maximum value Qmax of the heat generation amount. Here, the control device (1, 1A, 1B) includes a combustion speed calculation unit that calculates a combustion speed in one combustion cycle based on CA10 or CA50. The combustion speed calculation unit can calculate the combustion speed by calculating a period (CA50–CA10) from the crank angle CA10 where Qmax×0.1 to the crank angle CA50 where Qmax×0.5, which is 50% of the maximum value Qmax, for example.

The combustion stability judgment unit (250, 470) of the control device (1, 1A, 1B) evaluates that the combustion state is stable if the period (combustion speed: CA50–CA10) is within a predetermined set range, and evaluates that the combustion state is unstable if the period is beyond the predetermined set range. This makes it possible to correctly judge (evaluate) the stability of the combustion state also in the transient state as in the first and second embodiments.

As described above, in the first and second embodiments, the combustion stability is evaluated by evaluating the distribution of combustion energy. However, in addition to the combustion energy in each combustion cycle, the combustion parameter for evaluating the combustion stability may be the peak position θPmax of combustion (that is, combustion timing) or the length of the period in which a certain rate of heat is generated (that is, combustion speed).

In addition, the distribution of the combustion parameters described above is detected, and if the distribution width is larger than an allowable value, failures occur such as large vibration of the internal combustion engine 100 and misfire occurrence. Therefore, by the above embodiments, it is desirable to control the injector so as to increase the injection fuel in order to increase the air-fuel ratio when it is detected that the combustion has become unstable due to a large distribution width of the combustion parameters or when it is detected that the combustion parameters have suddenly changed. Thus, combustion can be stabilized.

In addition, in order to rapidly warm an exhaust catalyst at the time of starting, by delaying (retarding) the ignition timing, it is possible to perform a control of converting heat generated in the cylinder 102 more into the exhaust heat than into the work amount to the piston 104. The more the ignition timing is delayed, the faster the catalyst warms, but also the more the combustion instability becomes. Therefore, by the above embodiments, it is desirable to control the ignition plug so as to return the retard of the ignition timing when it is detected that the combustion has become unstable due to the large variation of the combustion parameters or when it is detected that the combustion parameters have suddenly changed. This makes it possible to stabilize combustion.

As described above, the internal combustion engine control device 1, 1A, 1B described in the above embodiments includes a control unit (microcomputer) that controls either the air-fuel ratio of the internal combustion engine or the ignition timing based on the combustion stability calculated by the combustion stability judgment unit (250, 470, 650).

The above embodiments have been described by way of example in which the internal combustion engine control device 1, 1A, 1B is applied to the internal combustion engine 100 for a vehicle. However, the present invention is not limited thereto, and can be applied to internal combustion engines for vessels, aircrafts, and various other types of equipment. Furthermore, it is possible to realize the present invention by combining all the embodiments described above or by combining any two embodiments. Furthermore, the present invention is not limited to those having all the configurations of the above embodiments, and part of the configuration of one embodiment may be replaced with the configuration of another embodiment. Moreover, part of the configuration of one embodiment may be added to, deleted from, or replaced by the configuration of another embodiment.

REFERENCE SIGNS LIST

1 control device
100 internal combustion engine
101 intake pipe
102 cylinder
1021 first cylinder
1022 second cylinder
1023 third cylinder
1024 fourth cylinder
103 crankshaft
1031 crank angle sensor
1032 memory board
104 piston
105 intake valve
105A intake port
106 exhaust valve
106A exhaust port
107 throttle valve
108 air flow sensor
109 fuel injection device
110 ignition plug
111 exhaust pipe
112 EGR pipe
113 cylinder pressure sensor
210 combustion energy calculation unit
220 storage unit
230 trend calculation unit
240 difference calculation unit
250 combustion stability judgment unit

The invention claimed is:

1. An internal combustion engine control device, comprising:

a combustion parameter calculation unit that calculates a combustion parameter of one combustion cycle in an internal combustion engine;

a trend calculation unit that calculates a trend of change in the combustion parameter calculated by the combustion parameter calculation unit in a plurality of the combustion cycles;

a combustion stability judgment unit that judges combustion stability based on the combustion parameter in the plurality of combustion cycles and the trend of change calculated by the trend calculation unit; and a control unit that controls either an air-fuel ratio of the internal combustion engine or an ignition timing based on the combustion stability calculated by the combustion stability judgment unit.

2. The internal combustion engine control device according to claim 1, comprising:

a difference calculation unit that calculates a difference between the trend of change in the combustion parameter in the plurality of combustion cycles calculated by the trend calculation unit and the combustion parameter per combustion cycle calculated by the combustion parameter calculation unit, wherein the combustion stability judgment unit judges combustion stability based on the difference calculated by the difference calculation unit.

3. The internal combustion engine control device according to claim 1, wherein the trend calculation unit calculates the trend of change in the combustion parameter by approximating a distribution of the combustion parameter in the plurality of combustion cycles by a linear function.

4. The internal combustion engine control device according to claim 1, wherein the combustion parameter is any of combustion energy, combustion timing, and combustion speed in the combustion cycle.

5. The internal combustion engine control device according to claim 1, comprising a control unit that controls either an air-fuel ratio of the internal combustion engine or ignition timing based on the combustion stability judged by the combustion stability judgment unit.

6. The internal combustion engine control device according to claim 1, wherein the combustion cycle in the internal combustion engine is a combustion cycle in a transient state of the internal combustion engine.

7. An internal combustion engine control device, comprising:

a combustion parameter calculation unit that calculates a combustion parameter of one combustion cycle in an internal combustion engine;

a trend calculation unit that calculates a trend of change in the combustion parameter calculated by the combustion parameter calculation unit in a plurality of the combustion cycles;

a variance calculation unit that calculates a variance of the combustion parameter based on the combustion parameter in the plurality of combustion cycles;

a combustion stability judgment unit that judges combustion stability based on the trend of change in the combustion parameter in the plurality of combustion cycles calculated by the trend calculation unit and the variance of the combustion parameter calculated by the variance calculation unit; and a control unit that controls either an air-fuel ratio of the internal combustion engine or an ignition timing based on the combustion stability calculated by the combustion stability judgment unit.

8. The internal combustion engine control device according to claim 7, wherein the variance calculation unit calculates a variance of the combustion parameter in the plurality of combustion cycles from a mean value of the combustion parameters in the plurality of combustion cycles.

9. The internal combustion engine control device according to claim 8, comprising an effect removal unit that removes an effect of a trend of change in a combustion parameter by subtracting a contribution due to the trend of change in the combustion parameter calculated by the trend calculation unit from the variance of the combustion parameter from the mean value calculated by the variance calculation unit.

10. The internal combustion engine control device according to claim 9, wherein the combustion stability judgment unit judges combustion stability based on an index value of a distribution of a combustion parameter from which the effect of the trend of change in the combustion parameter has been removed by the effect removal unit.

11. An internal combustion engine control device, comprising:

a combustion parameter calculation unit that calculates a combustion parameter of one combustion cycle in an internal combustion engine;

a trend calculation unit that calculates a trend of change in the combustion parameter calculated by the combustion parameter calculation unit in a plurality of the combustion cycles;

a combustion sudden change judgment unit that judges a sudden change in a combustion state based on the combustion parameter in the plurality of combustion cycles and the trend of change calculated by the trend calculation unit; and a control step that controls either an air-fuel ratio of the internal combustion engine or an ignition timing based on the combustion stability calculated by the combustion stability judgment unit.

12. The internal combustion engine control device according to claim 11, comprising:

a difference calculation unit that calculates a difference between the trend of change in the combustion parameter calculated by the trend calculation unit and the combustion parameter calculated by the combustion parameter calculation unit, wherein the combustion sudden change judgment unit judges that the combustion parameter in the combustion cycle has suddenly changed when the difference calculated by the difference calculation unit exceeds a set threshold value.

13. An internal combustion engine control method, comprising:

a combustion parameter calculation step of calculating a combustion parameter of one combustion cycle in an internal combustion engine;

a trend calculation step of calculating a trend of change in the combustion parameter in a plurality of the combustion cycles;

a combustion stability judgment step of judging combustion stability based on the combustion parameter in the plurality of combustion cycles and the trend of change in the combustion parameter;

a control step that controls either an air-fuel ratio of the internal combustion engine or an ignition timing based on the combustion stability calculated by the combustion stability judgment unit.

* * * * *